United States Patent [19]

Dörling et al.

[11] 4,103,647

[45] Aug. 1, 1978

[54] APPARATUS FOR DRYING WET STEAM AND SUBSEQUENTLY SUPERHEATING THE DRIED STEAM

[75] Inventors: Rolf Dörling; Klaus Westebbe, both of Gummersbach, Fed. Rep. of Germany

[73] Assignee: L. & C. Steinmüller GmbH, Gummersbach, Fed. Rep. of Germany

[21] Appl. No.: 748,962

[22] Filed: Dec. 9, 1976

[30] Foreign Application Priority Data

Dec. 10, 1975 [DE] Fed. Rep. of Germany ..... 2555539

[51] Int. Cl.[2] ..... F22G 1/00; F22B 1/16; F22B 37/26

[52] U.S. Cl. ..... 122/483; 122/34; 122/491

[58] Field of Search ..... 122/34, 483, 491

[56] References Cited

U.S. PATENT DOCUMENTS

| | | | |
|---|---|---|---|
| 2,995,343 | 8/1961 | Gardner | 122/483 |
| 3,209,731 | 10/1965 | Schonberger et al. | 122/483 |
| 3,500,796 | 3/1970 | Roffler | 122/483 |

FOREIGN PATENT DOCUMENTS

| | | | |
|---|---|---|---|
| 368,448 | 4/1973 | U.S.S.R. | 122/483 |

*Primary Examiner*—Kenneth W. Sprague
*Attorney, Agent, or Firm*—Walter Becker

[57] ABSTRACT

An apparatus for drying wet steam and subsequently superheating the dried steam, which comprises an upright cylindrical container with a coarse separator in the bottom region of the container and with an axially upwardly following fine separator. Arranged within the container in the axially upward direction of the fine separator is a passage around which there are located superheating elements which are parallel to the axis of the container and extend nearly up to the upper bottom of the container.

7 Claims, 3 Drawing Figures

APPARATUS FOR DRYING WET STEAM AND SUBSEQUENTLY SUPERHEATING THE DRIED STEAM

The present invention relates to a device for drying wet steam and subsequently superheating the dried steam. More specifically, the present invention concerns a device of the just mentioned type which comprises upright cylindrical containers with a coarse separator arranged within the region of the bottom, and furthermore comprises an adjacent fine separator which in axial and upward direction follows said coarse separator, a superheater following said fine separator. For purposes of drying wet steam and subsequently superheating the same, nowadays devices are employed in which the two treatments follow each other. In this connection, the drying of the wet steam presents some problem in view of the requirement for a uniform actuation of the two cylinders. According to the heretofore known devices of the type involved, the separators or separator elements are over their entire height arranged parallel to the superheater elements. With such an arrangement, however, due to the considerable length of the separator elements, a uniform actuation by the steam-water mixture can be obtained only under considerable difficulties.

Another drawback of these heretofore known arrangement consists in that the pressure losses occurring in the separators and the superheaters have to be absorbed by the container mantle as reaction forces which fact calls for additional structural auxiliary means. In view of the partition along the axis of the container, forces are created during the operation in view of the different temperatures in the container and the partitioning element. In view of these temperature differences at the in-flow and out-flow side, inherently different expansions occur resulting in a deformation (banana shape) of the entire container.

It is, therefore, an object of the present invention to provide a device for drying wet steam and subsequently superheating the dried wet steam, in such a way that the problems heretofore encountered in connection with the steam-water distribution can be properly mastered.

It is a further object of this invention so to design the device set forth in the preceding paragraph that by a certain arrangement of auxiliary devices for the drying and the heating of the steam, the forces previously generated by the pressure differences in the different treatment stages will no longer have to be compensated for by the container itself but by the auxiliary devices.

These and other objects and advantages of the invention will appear more clearly from the following specification in connection with the accompanying drawings, in which.

Figure 1:
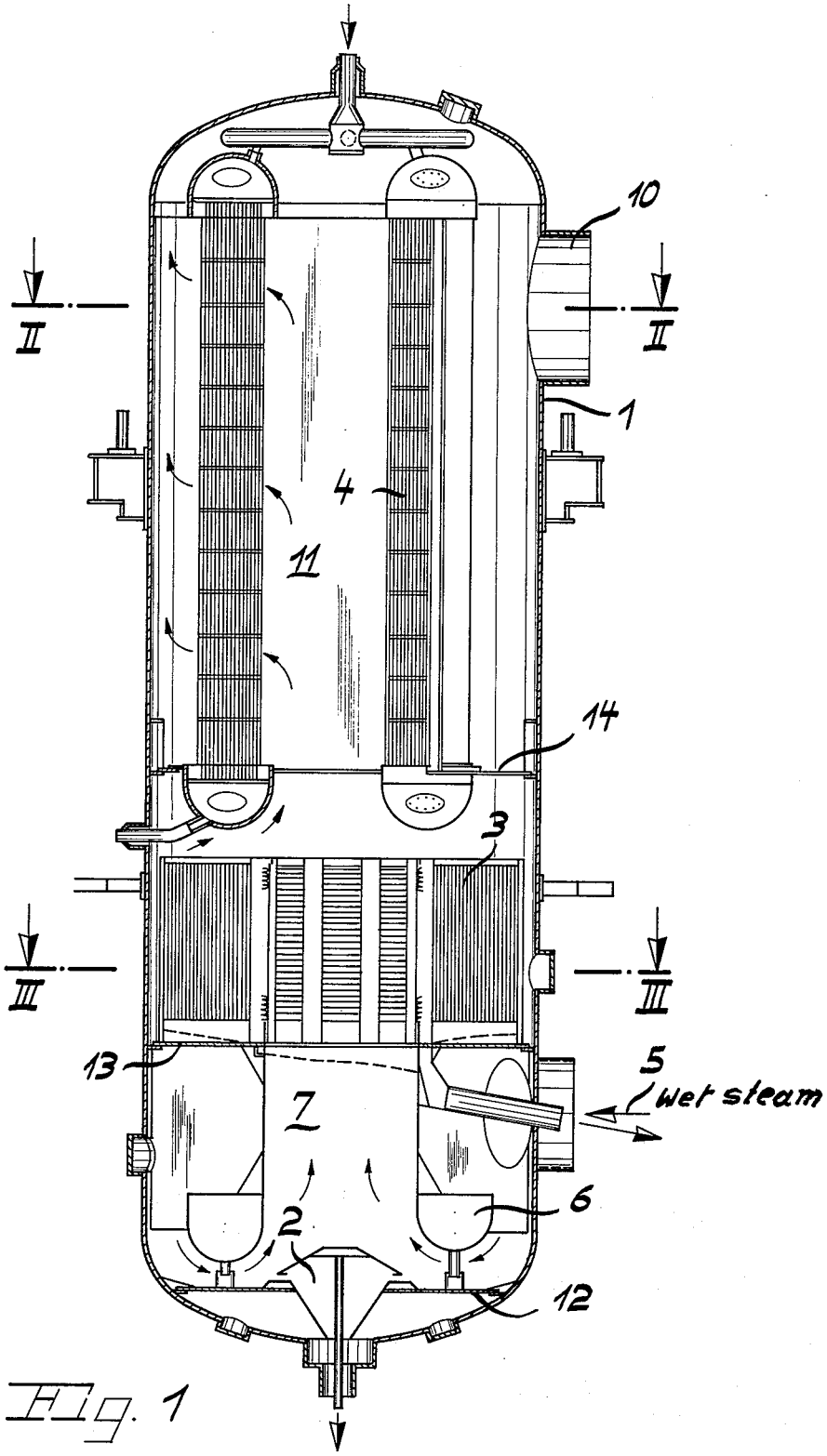
FIG. 1 illustrates a longitudinal section through an embodiment of the present invention.
Figure 3:
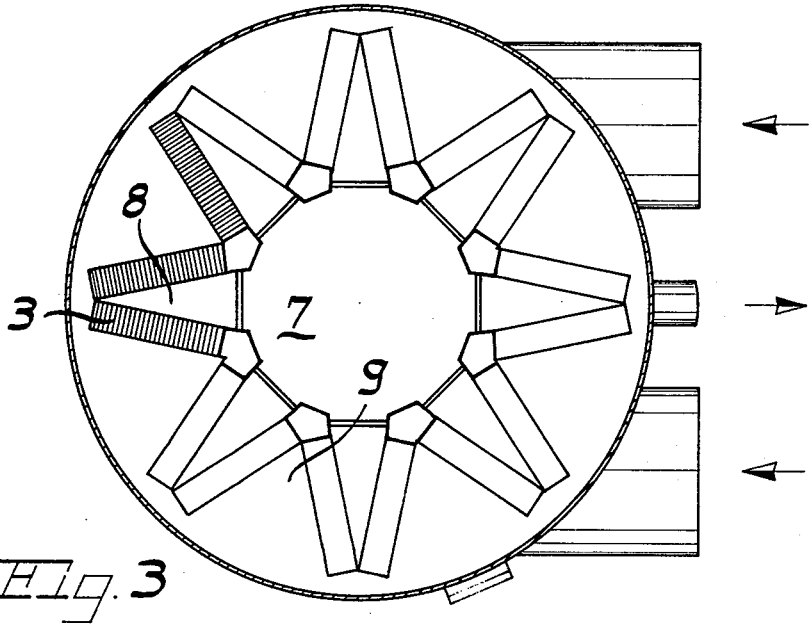

FIG. 3 is an additional horizontal section through the device of FIG. 1, said section being taken along the line III—III of FIG. 1. The device according to the present invention for drying wet steam and for subsequently superheating the dried steam, which comprises an upright cylindrical container with a coarse separator arranged within the bottom region, and a fine separator following in axial upward direction, is characterized primarily in that the superheater elements are arranged around a coaxial passage above said fine separator, said superheating elements extending parallel to the container axis up to a point near the upper bottom.

With the device according to the invention, the steam exit connection may be arranged laterally as well as centrally in the upper bottom. Depending on the position of the steam outlet connection, it is furthermore provided according to the invention that the coaxial passage, with lateral discharge of the superheated steam, forms the inflow chamber, and with the discharge of the superheated steam centrally from the upper bottom, forms the discharge chamber.

The arrangement of the superheater elements around the coaxial passage arranged above the fine separator may according to a further development of the invention be such that the superheater elements may be employed in even or odd number while the angular position around the coaxial passage may be even and/or uneven.

Figure 2:
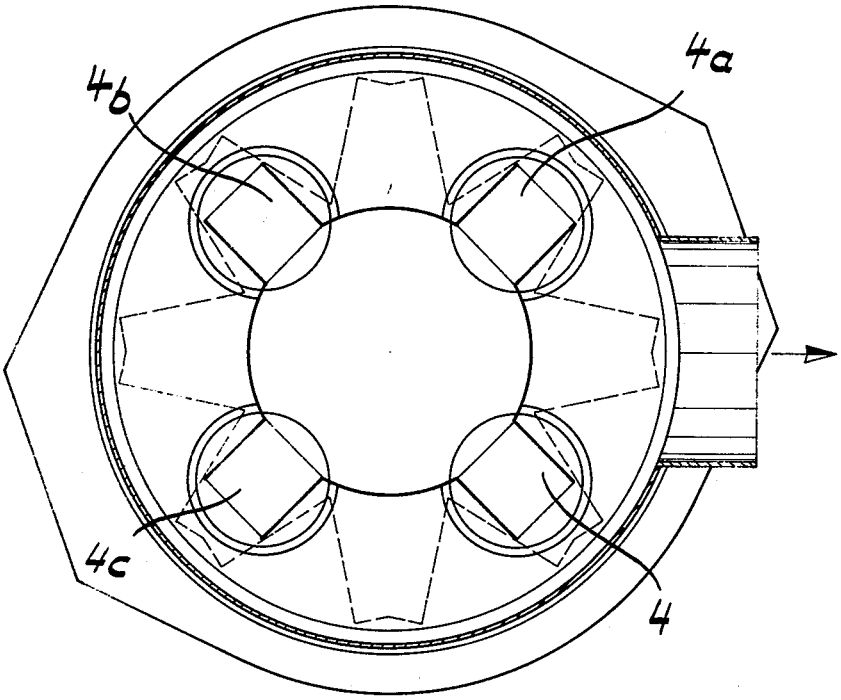
FIG. 2 is a horizontal section taken along the line II—II of FIG. 1.

Referring now to the drawings in detail, the present invention comprises a container 1 and auxiliary devices for the drying and superheating of the steam, said auxiliary devices being inserted into the container. The drying of the steam is effected by a coarse separator 2 and a fine separator 3. The superheating is effected by superheater elements 4. The wet steam enters the container 1 in the direction of the arrow 5 and by means of deflectors 6 is deflected so that the steam is directed through the coarse separator 2 for separating coarse water droplets. Subsequently the wet steam continues flowing in passage 7 and passes into the fine separator 3 the arrangement of which is more clearly shown in FIG. 3. As will be seen from FIG. 3, the flow of the steam is indicated by the arrows. The reference numeral 9 designates the flow-off cross sections for the dried steam. With the particular embodiment shown, due to the lateral steam exit 10, the passage 11 is provided as inflow or feeding passage for the superheater elements 4. The superheater elements 4, 4*a*, 4*b*, 4*c* are arranged in conformity with FIG. 2. As will be seen therefrom, the angular position of the individual superheater elements 4 is such that the axes thereof define with each other angles of 90° . However, the mutual angular position of the superheater elements 4 is not limited to 90° but may also be for instance 45° or 120°. Furthermore, it is not necessary that the angular position of the superheater elements 4–4*c* is uniform. Thus, for instance, the superheater elements 4, 4*a* may with each other define an angle of 90° whereas the angular position of the superheater elements 4*b* and 4*c* may be such as to define an angle of 120° or 45° with each other. Furthermore, it is possible to employ not only four superheater elements but three or eight superheater elements. Thus, an even as well as an odd number of superheater elements is possible. The auxiliary devices, namely the coarse separator 2, fine separator 3 and superheater elements 4–4*c* are connected to the container mantle 1 by separate supporting constructions.

As will be evident from the above, the advantages of the present invention are seen primarily in that due to a clear separation of the steam treatment phases — drying, superheating — the problems heretofore inherent to the steam-water distribution over great heights are no longer present because the steam drying process is carried out at a container height to which the necessary uniform distribution of steam and water over the separator elements is assured.

The superheater elements arranged in upward direction around the coaxial passage and parallel to the longitudinal axis of the container are not connected to the drying elements and the container itself as with the embodiment referred to above. Thus, the forces resulting from the pressure losses of both systems namely separator system and superheater system are no longer introduced into the container mantle but are compensated for in the systems themselves.

The particular arrangement of the superheating elements around the coaxial passage assures a uniform thermal actuation of the container mantle over its circumference so that deformation of the container (banana shape) will no longer occur. This separation of the systems from each other and their arrangement according to the invention with regard to each other result in the obviation of stresses upon the container mantle which stresses are due to relative expansions.

It is, of course, to be understood that the present invention is, by no means, limited to the specific showing in the drawings but also comprises any modifications within the scope of the appended claims.

What we claim is:

1. An apparatus for drying wet steam and subsequently superheating the dried steam, which includes in combination: an upright cylindrical container having an axis as well as a lower bottom and an upper bottom, a coarse separator arranged inside said container and within the region of said lower bottom, a fine separator arranged within said container and following said coarse separator in axially upward direction of said coarse separator, said container being provided with upwardly directed coaxial passage means, and superheating elements arranged around said coaxial passage means and extending parallel to the container axis nearly up to said upper bottom.

2. An apparatus in combination according to claim 1, in which the upper end portion of said container has a steam outlet laterally connected thereto, and in which said passage means form a feeding passage for the steam to said superheating elements.

3. An apparatus in combination according to claim 1, in which the central portion of said upper bottom is provided with an outlet for the superheated steam, and in which said passage means forms the discharge chamber for the superheated steam.

4. An apparatus in combination to claim 1, in which an uneven number of superheating elements is arranged around said passage means.

5. An apparatus in combination according to claim 1, in which the number of superheating elements arranged around said passage means is even.

6. An apparatus in combination according to claim 1, in which the axes of each pair of adjacent superheating elements define with each other an angle of substantially the same magnitude.

7. An apparatus in combination according to claim 1, in which the axes of at least one pair of adjacent superheating elements define with each other an angle different from at least one angle defined by the axes of another pair of adjacent superheating elements.

* * * * *